United States Patent [19]

Albert

[11] 4,253,257

[45] Mar. 3, 1981

[54] SNOW REMOVAL DEVICE AND METHOD OF USING IT

[76] Inventor: Donald F. Albert, Morris Hubbard Rd., Higganum, Conn. 06441

[21] Appl. No.: 59,693

[22] Filed: Jul. 23, 1979

[51] Int. Cl.[3] ..... E01H 5/02

[52] U.S. Cl. ..... 37/195; 37/53; 15/257.9; 294/54

[58] Field of Search ..... 37/53, 130, 195; 294/49, 54, 55-57; 248/99; 15/257.1, 257.2, 257.3, 257.4, 257.5, 257.6, 257.7, 257.8, 257.9

[56] References Cited

U.S. PATENT DOCUMENTS

| | | | |
|---|---|---|---|
| 398,330 | 2/1889 | Jacobs | 294/54 |
| 860,746 | 7/1907 | Hoffman | 294/55 |
| 2,742,719 | 4/1956 | Rabideau | 37/123 |
| 3,007,263 | 11/1961 | Lair | 37/53 |
| 3,154,336 | 10/1964 | Nelson | 294/54 |
| 3,155,413 | 11/1964 | Holombo | 294/54 |
| 3,475,838 | 11/1969 | Hagen et al. | 37/53 |
| 3,754,785 | 8/1973 | Anderson | 294/55 |
| 3,998,486 | 12/1976 | Mittelstadt | 37/53 |
| 4,161,073 | 7/1979 | Oakes | 37/130 |
| 4,185,403 | 1/1980 | Hardgrove | 37/53 |

*Primary Examiner*—E. H. Eickholt

[57] ABSTRACT

A snow-removal device includes a frame having a handle at one end and a blade at the other. The frame rests on the ground at the blade end, and a flexible sheet extends from the blade end back toward the handle end. The sheet is attached at either end but is free to bend lengthwise so that the length of the sheet resting on the ground varies as the handle is lifted. This arrangement permits the device to be emptied with a minimum of strain on the user.

19 Claims, 9 Drawing Figures

SNOW REMOVAL DEVICE AND METHOD OF USING IT

BACKGROUND OF THE INVENTION

Although the present invention can be used with other materials, it will find its primary use as a device for removing snow.

A wide range of snow-removal devices already exist. They range from the relatively simple and inexpensive snow shovel through snow blowers and snowplows. At the one end of the spectrum, the snow shovel is simple and inexpensive and requires almost no maintenance. However, it quite often requires a great deal of energy to use, even on a small area. At the other end of the spectrum is the snowplow, which requires a fair degree of maintenance and is usually considered too expensive for private domestic use. Even a snow blower, which is often used for ordinary residential purposes, is somewhat expensive when the low frequency of use is considered. Accordingly, a need exists for a snow-removal device whose use does not require the amount of effort that a snow shovel demands but is relatively simple in construction and requires little maintenance.

This need has been identified in the past, and numerous solutions have been proposed. Most of the solutions achieve the desired results to an extent, but as the teachings of the present invention will show, further improvement is possible. An example of the attempts in the prior art to fill the gap between the snow shovel and the more complicated devices is illustrated in U.S. Pat. No. 3,475,838 to Hagen et al., in which a scoop-type device is illustrated with a handle for propelling the scoop into the snow and wheels for facilitating movement of the scoop along the ground. The device is relatively simple, and it provides a mechanical advantage by virtue of the lever arm provided by the handle to pivot the device around the axis of the wheels. It is not necessary with such devices to lift the snow to remove it, and when it is desired to empty the device, the user pushes up on the handle, employing the mechanical advantage to unload the snow. There is still some lifting of the snow to empty the scoop, but the mechanical advantage reduces the effort expended by the user. Furthermore, a larger amount of snow can typically be moved at one time than is possible with the ordinary snow shovel.

A number of devices in the prior art illustrate similar arrangements, an example being the one illustrated in U.S. Pat. No. 2,742,719 to Rabideau. It is possible with the device illustrated in Rabideau to almost completely eliminate the lifting requirement; the scoop is pushed into the snow to load it and then dragged in the disposal site. When it is desired to unload the device, a movable floor in the scoop is retracted in the manner of a roll-top desk, and the snow falls out. The Rabideau device would seem to reduce the amount of energy that the user must expend in snow removal, and the device is simple when compared to, say, a snow blower. However, it is thought that the device itself is somewhat heavy, and the roll-top-desk arrangement is certainly a complexity that the user may wish to avoid.

It is accordingly an object of the present invention to provide a snow-removal device that is relatively light in weight, requires a relatively small amount of force to empty, and is very simple in construction.

SUMMARY OF THE INVENTION

The foregoing and related objects are achieved in a novel snow-removal device. It includes a frame having a blade end providing a leading edge adapted to be propelled into an accumulation of snow and having a handle end opposite the blade end for propelling the leading edge into the snow. An elongated flexible sheet member is also included that has first and second opposite ends and consists essentially of a synthetic resin that maintains flexibility at temperatures at least as low as 0° C. First sheet attachment means provide an attachment to the frame for the elongated sheet at the blade end in position to receive snow thereon when the leading edge of the frame is propelled into an accumulation of snow. Second sheet attachment means provide an attachment for the second end of the flexible sheet member to the frame toward the handle end thereof to provide support of the second end of the sheet member by the frame. The sheet member and the first and second attachment means therefor are of sufficient length to permit slack in the sheet member. The sheet member is freely movable relative to the frame intermediate the attachment means to permit part of the sheet member to rest on a generally horizontal surface when the blade end rests on the surface and the handle end is supported above the surface, and the length of the sheet resting on the generally horizontal surface is permitted to reduce gradually as the handle is raised. A load of snow resting on the sheet member is thereby lifted only a portion at a time as the handle end is raised.

The first sheet-attachment means typically includes an elongated rigid member joined along its length to the flexible sheet member along the first end of the sheet member to keep the first end rigid. It also typically includes connection means that connect the rigid member to the frame at the blade end for pulling of the rigid member and thereby of the flexible sheet member by the frame. The connection means permits some motion of the rigid member relative to the leading edge to allow one end of the rigid member to tilt to a position below the other when the leading edge is oriented horizontally.

The second attachment means typically includes a flexible cord depending from the frame at a point toward its handle end and connected to the flexible sheet to support it at its second end. It also typically includes a second elongated rigid member joined along its length to the flexible sheet member along its second end to keep the second end rigid. Also included is a second flexible cord depending from the frame at its one side toward the handle end and attached to the rigid elongated member to support the second end of the sheet member. The first-mentioned flexible cord depends from the frame at its other side and is attached to the elongated member to support the sheet member at its second end.

The flexible sheet may conveniently have an opening sized for extension through it of human fingers at the second end of said flexible sheet adjacent the rigid elongated member to facilitate grasping of the rigid member and thereby of the sheet.

The frame normally includes an elongated generally planar blade member disposed across its blade end and providing the leading edge. The angle of the plane of the blade member is variable when the first end rests on the generally horizontal surface by the raising or lowering said handle end of the frame. In such an arrangement the connection means connecting the rigid member to the frame may include at least one S-hook connecting the blade member to the rigid member.

In the preferred embodiment, the frame includes a generally U-shaped member having a pair of leg portions and a web portion extending between them at one end, the free ends of the leg portions being curved out of the plane of the U to provide a rocking surface at the other end at which the blade end of the frame can lie on the generally horizontal surface and along which it can be rocked as the handle end of the frame is raised and lowered. The blade member extends between and is fastened to the curved regions of the leg portions. The angle of the plane of the blade member is thereby variable by the raising and lowering of the handle end of the frame.

The frame further includes a second generally U-shaped member having two leg portions and a web portion extending between them. The web portion of said second U-shaped member provides a handle at said handle end of the frame, and the leg portions of the second U-shaped member extend from the handle and generally parallel to the leg portions of the first U-shaped member. The frame also has frame attachment means attaching the leg portions of the second U-shaped member to the leg portions of the first U-shaped member adjacent its web portion and supporting the second U-shaped member in its parallel position relative to the first U-shaped member but being loosenable to permit the second U-shaped member to pivot about the frame attachment means relative to the first U-shaped member for folding of the frame.

The sheet member may consist essentially of polyethylene terephthalate.

BRIEF DESCRIPTION OF THE DRAWINGS

These and further features and advantages of the present invention are described in connection with the attached drawings, in which.

DETAILED DESCRIPTION OF THE PREFERRED EMBODIMENT

Figure 1:
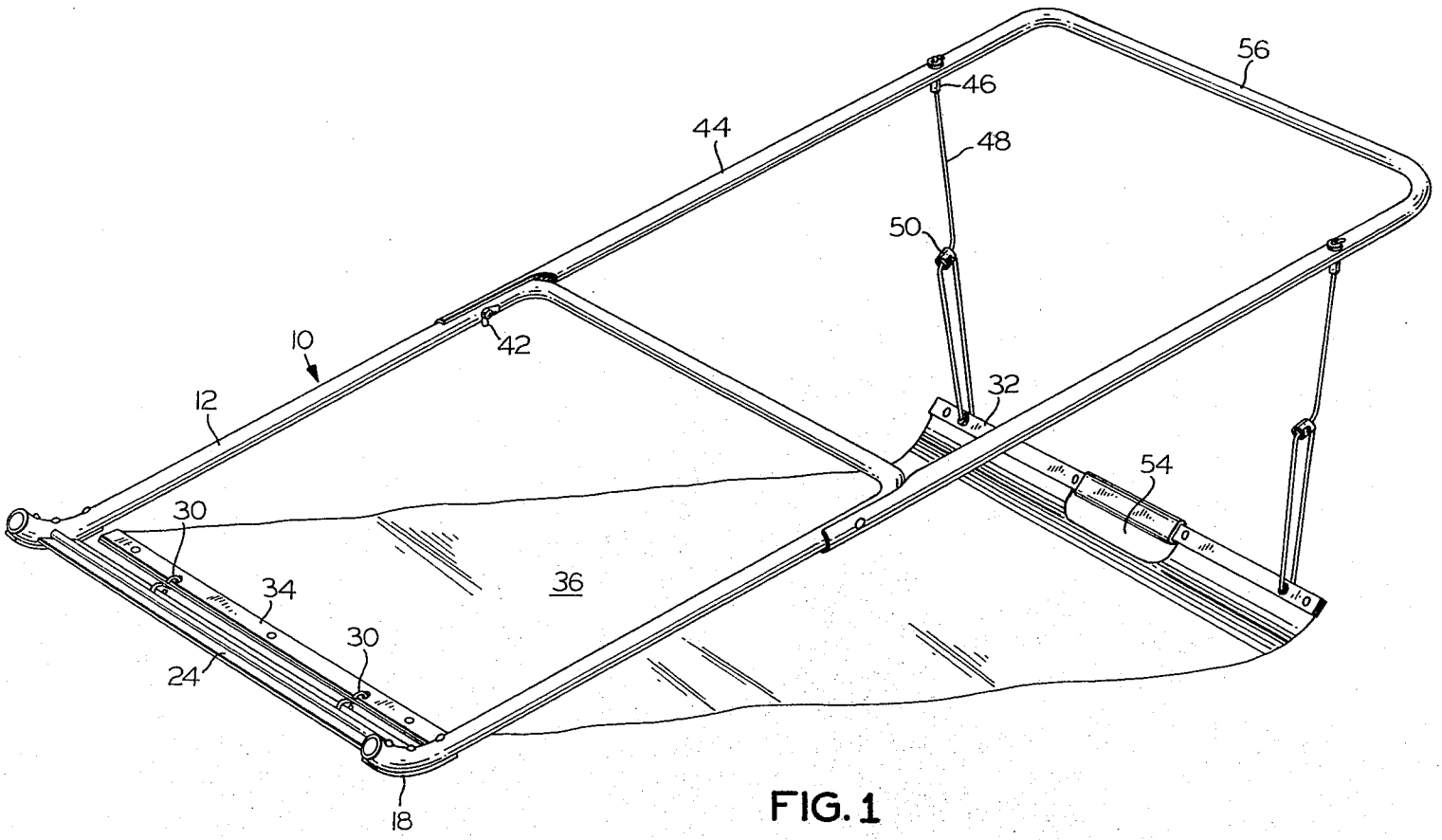
FIG. 1 is a perspective view of the snow-removal device of the present invention.

FIG. 1 illustrates one embodiment of the present invention, in which a sheet member 36, typically a heavy-gauge sheet of some plastic such as polyethylene or polyethylene terephthalate, is attached to a simple frame 10 by means of which it is propelled along the ground, sliding on runners 18. A leading edge is provided by a blade 24 that is pushed under the snow to be scooped when the device is propelled by pushing on its handle 56.

The frame 10 includes two U-shaped tubular members 12 and 44. Tubular members 12 and 44 would typically be made of aluminum to keep down the low weight of the structure. It may be desired in some applications to make the frame out of a single U-shaped member so that the web portion of U-shaped member 12 does not act as an obstruction to the snow that is being loaded on sheet member 36. However, it is thought that the arrangement in FIG. 1 will be preferred in many cases because it allows the frame to be folded. Recesses are formed at the free ends of the leg portions of U-shaped member 44 to receive the leg portions of member 12 near its web portion. The two parts are held together by screws and wing nuts 42, and folding is possible by the loosening of the wing nuts to permit the leg portions of U-shaped member 44 to expand slightly and thereby permit U-shaped member 44 to pivot onto U-shaped member 12.

The blade member 24 could conveniently be an elongated planar piece of reinforced steel of sufficient strength to withstand being propelled into obstacles such as hard ice or rocks. It extends between the free ends of the leg portions of U-shaped member 12 and is secured to them in a manner that will be described more fully below. S-hooks 30 are connected between blade member 24 and generally planar elongated slats 34 that are oriented generally parallel to blade member 24. Slats 34 may be riveted to the front ends of flexible sheet 36 to keep its front end rigid. Slat members 34 and S-hooks 30 thereby attach the elongated sheet to the frame.

Similar slats 52 are provided at the other end of flexible sheet 36, again providing rigidity at the ends but allowing flexibility intermediate the ends. Attachment to the frame toward the handle end is provided by ropes 48 that are fastened to either leg portion of U-shaped member 44 near the handle end. A cord such as rope 48 may pass through a suitable sleeve 46 positioned in a hole through the U-shaped member to protect the rope from sharp edges. Ropes 48 are threaded through holes in the rear slat members 52 and terminate in small plastic tubes 50 that act as adjustment means. A bight is formed at an appropriate point in the rope and is inserted into one end of the tube. The free end passes through a hole in the wall of the tube, capturing the bight, and is held in place by a knot on the exterior of the tube. This arrangement allows the effective length of rope 48 to be adjusted but prevents slippage when the rope is under tension.

An opening 54 is formed in flexible sheet 36 adjacent the rear slat member 52 to facilitate the grasping of flexible sheet 36 at the rear end. It has been found that this opening provides a convenient means for shaking residual snow off the sheet.

Figure 2:
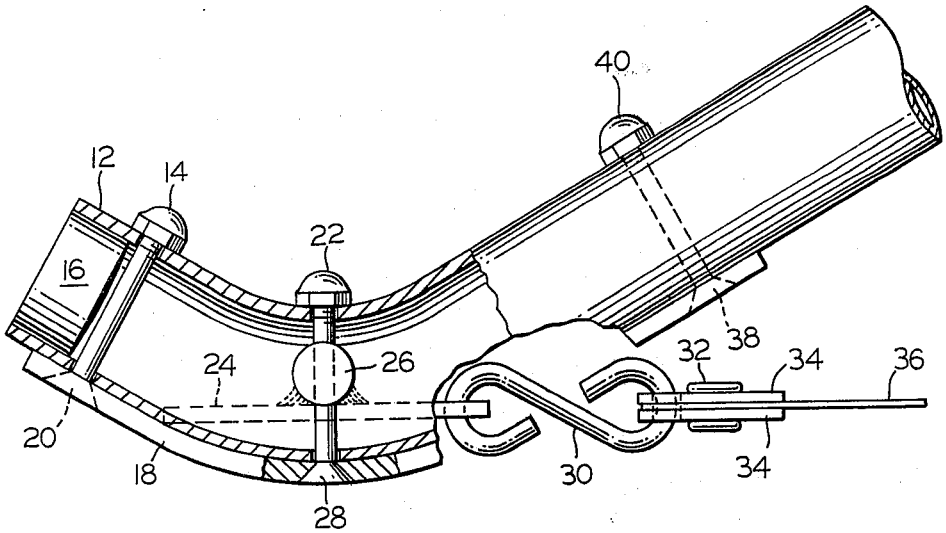
FIG. 2 is a side sectional view of the blade end of the snow-removal device of FIG. 1.

The connection of blade member 24 to the frame is seen more clearly in FIG. 2, in which an elongated blade mounting bar extends between the ends of the leg portions of U-shaped member 12 and is received in transverse openings in the leg portions. A flat-headed bolt 28 that is countersunk in runner 18 extends vertically through the front end of the leg portion of U-shaped member 12 and through a suitable hole in blade mounting bar 26. The bolt continues upward through a hole in the upper surface of the leg portion and is fastened with an appropriate nut 22. Blade portion 24 is fastened to mounting bar 26 by any appropriate means, preferably by a weldment along its length, and blade member 24 is thereby held rigidly in place.

FIG. 2 also shows further details of this portion of the snow-removal device. A polyethylene plug 16 is inserted into the open end of U-shaped member 12 to prevent snow and ice from accumulating inside it. Further flathead bolts 20 and 38 secure runner 18 to U-shaped member 12 with the aid of further nuts 14 and 40. Runner 18 would typically be made of, say, eighth-inch steel to protect the relatively thin aluminum U-shaped member 12. Of course, this expedient may not be necessary if different materials or greater thicknesses are used, but it is thought that this arrangement will be found preferable if a lightweight frame is desired.

Figure 3:
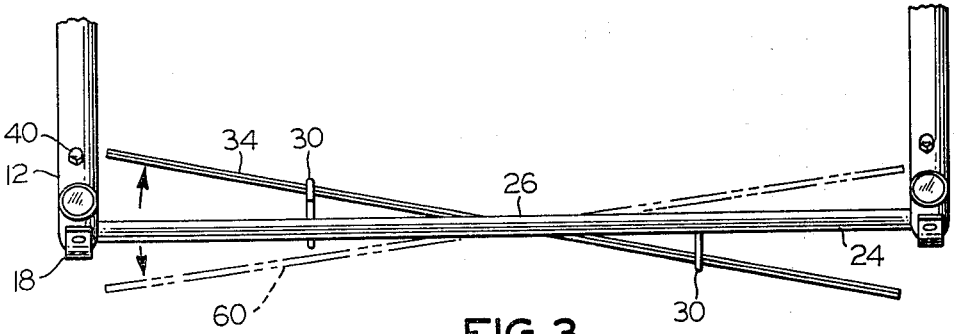
FIG. 3 is a front elevation of the device of FIG. 1 illustrating the motion of the front end of the sheet member relative to the leading edge of the frame.

One of the S-hooks 30 that connects slat members 34 to blade member 24 is also shown in FIG. 2. A pair of slat members is held together by appropriate rivets 32 or other fastening devices to clamp the flexible sheet member 36 between them. This permits sheet member 36 to be pulled by the frame while allowing some relative motion, as is seen in FIG. 3. As FIG. 3 shows, the S-hooks permit slat members 34 to move between various angles relative to blade member 24. One extreme position is shown in solid in FIG. 3, while phantom 60 shows another extreme position. As will be described in connection with FIG. 9, this relative movement is sometimes beneficial when the sheet is being emptied.

Figure 4:
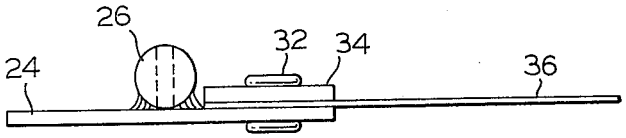
FIG. 4 is a side elevation with parts removed of an alternate arrangement for attaching the sheet member to the frame.

Although the relative motion between slat member 34 and the front edge of the frame is desirable in some situations, such motion is not required, and it may be preferred to provide the attachment between sheet 36 and the frame by any of a number of other arrangements, one of which is illustrated in FIG. 4. In FIG. 4, reference numeral 26 refers to the same blade mounting bar identified by reference numeral 26 in FIG. 2, and other parts are also similarly numbered. It can be seen in FIG. 4 that S-hook 30 has been dispensed with, and lower slat 34 from FIG. 2 has been replaced with blade member 24. As a result, sheet member 36 is now clamped between a single slat member 34 and blade member 24, which are held together by rivets 32.

Before a description of the operation of the device is provided, it should be noted in connection with FIG. 2 that the curved ends of the leg portions of U-shaped member 12, along with runners 18, allow a rocking action to occur at the front end of the frame when handle 56 (FIG. 1) is raised or lowered. This permits the angle of attack of blade 24 to be varied, and its distance from the surface on which runner 18 rests is thereby also varied. Accordingly, the amount of clearance between the blade and the ground or other surface can be varied by raising or lowering handle 56.

Figure 5:
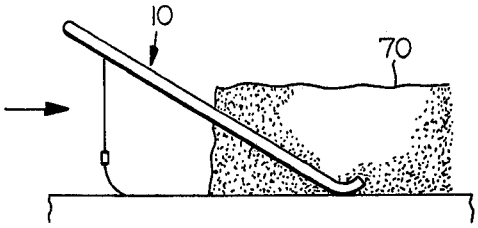
FIGS. 5 through 8 are simplified views illustrating the operation of the snow-removal device of the present invention.
Figure 6:
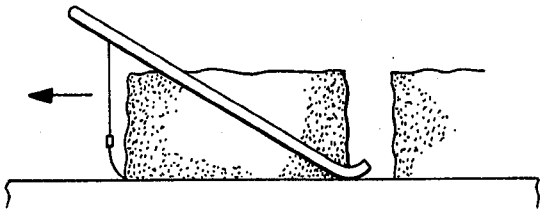
Figure 7:
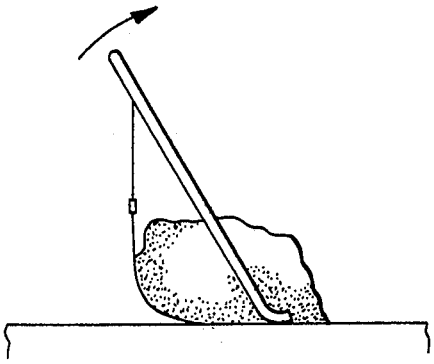

In operation, the device of the present invention is propelled into an accumulation of snow 70, as FIG. 5 illustrates. Although it is not apparent in FIG. 5, there is ordinarily a small layer of snow that remains on the ground beneath flexible sheet member 36. The flexible sheet is chosen from among materials such as polyethylene terephthalate that provide a low coefficient of friction between the sheet and the snow above and below. Accordingly, there is little friction, and it is quite easy to propel the device into the snow. The resistance experienced by the user is essentially limited to that offered by the snow against the cutting action of the blade. Once the device is filled, it is then merely withdrawn as illustrated in FIG. 6 and transported to the place where it is to be dumped. It is noted that it is not necessary to lift any of the snow, and if there is any snow along the route to the dumping area, there will be little frictional resistance to the dragging of the device to the site. Of course, there will be occasions in which it will be necessary to drag the device over ground that is not covered with snow, such as an asphalt driveway. For this reason, the flexible sheet member should be chosen to be relatively tough so that it can withstand such abrasive environments.

Upon arrival at the dump site, the user pushes up on the handle, pivoting the frame about the runners and lifting sheet member 36 from the rear. Sheet member 36 is chosen from among materials that will remain flexible at the low temperatures that are expected to be encountered during use, so it should remain flexible at least as low as 0° C., and preferably lower. As a result, since the device is constructed so that sheet member 36 is freely movable intermediate its ends, the vertex of the generally V-shaped form assumed by sheet member 36 moves forward on the sheet, and only a small portion of sheet member 38 is actually being lifted from the ground at any one time. As a result only a small portion of the snow is lifted at any one time. This adds to the ease contributed by the mechanical advantage resulting from the pivoting of the frame about runner 18 to make emptying of the device quite simple, even if a large amount of snow is being handled. Thus, although the device is quite simple, it affords significant advantages over prior art snow scoops.

Figure 8:
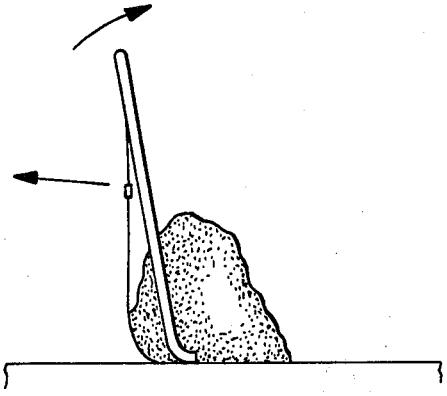

When nearly all of the snow has been emptied from the device, it is merely pulled back out of the resultant mound, as is illustrated in FIG. 8. At this point, the user may wish to grasp rear slat 52 through opening 54 (FIG. 1) and shake it to remove any remaining snow. The lightweight device may then be dragged or carried back to the area to be cleared.

Figure 9:
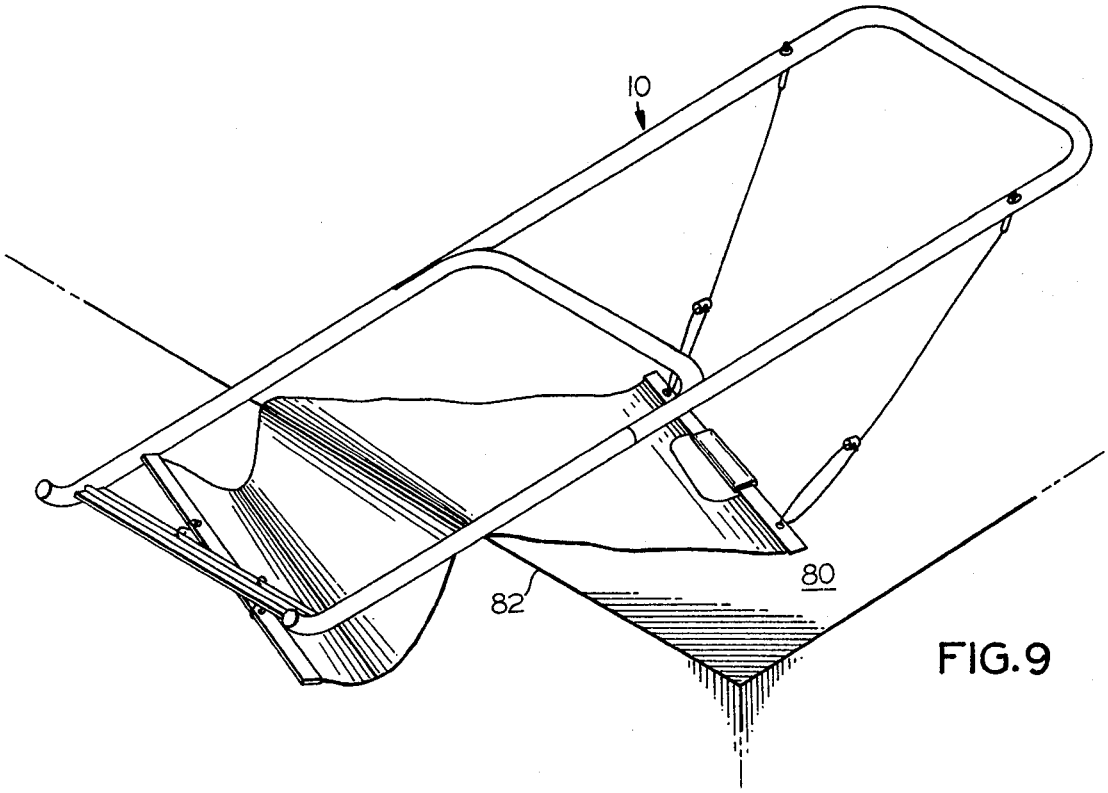
FIG. 9 is a further perspective view illustrating particular advantages inherent in the use of the present invention for clearing surfaces such as roofs.

One of the advantageous features of the present invention is illustrated in connection with FIG. 9, which shows why it may be desirable to attach the flexible sheet member by means of S-hooks. The present invention device was directed originally to solve the problem of removing snow from flat roofs, and in these and similar applications the emptying is particularly easy. FIG. 9 illustrates in simplified form the device extending over the edge 82 of roof or similar surface 80. For the sake of simplicity, no snow is shown in the device, but it can be appreciated that particularly if flexible sheet 36 has a slick surface such as can be provided by polyethylene terephthalate, it will not even be necessary to lift up on the handle to empty the device. As the frame extends out over the edge of the surface, the front end of flexible sheet 36 will no longer be supported, and it will normally be slightly heavier on one side or the other, causing front slat member 34 to tilt as is seen in FIG. 9, which allows the snow to slide off the slick sheet surface. In such a situation, it is only necessary to propel the device into an accumulation of snow and then push it across the edge of surface 80. As the device extends out over the edge, it empties itself. Of course, this effect can be obtained even with the arrangement of FIG. 4, but it is more pronounced when the FIG. 1 embodiment is employed.

It is apparent from the foregoing description that the device is simple in construction and can easily be built to be quite low in weight. Despite its simple construction it provides significant advantages over prior art devices in that the deformation of the sheet member reduces the amount of force that must be applied to unload the snow. Furthermore, this type of arrangement lends itself to the use of a bottom (the sheet member) that has a low coefficient of friction in snow. This, of course, contributes to ease both in transporting the snow and unloading it.

It will also be apparent to those skilled in the art that many variations of the embodiment shown in the drawings can be made without departing from the principles that it illustrates. In particular, it is not necessary that the sheet be attached to the frame with flexible ropes as is shown in the preferred embodiment; although it is necessary for the practice of the present invention for the sheet member to be deformable in the direction shown along a substantial part of its length, the flexible ropes shown in the drawings could be replaced, if necessary, by rigid rods. In fact, no ropes or rods at all are absolutely required, since the sheet could be made long enough to extend all the way to the frame and to be connected directly to it in the rear.

Further variations will also be apparent to those skilled in the art. As was mentioned above, runners 18 are not absolutely necessary, although it is believed that they will be found desirable in most cases. The blade end of the frame could also include wheels that would reduce the friction even further when the device is being dragged over, say, an asphalt driveway. These and other variations of the device can be employed without departing from the teachings of the present invention.

Having thus described the invention, I claim:

1. A method of snow removal comprising the steps of:

a. providing a snow-removal device including:
   (i) a frame having a blade end providing a leading edge adapted to be propelled into an accumulation of snow and having a handle end opposite said blade end for propelling said leading edge into the snow;
   (ii) an elongated flexible sheet member having first and second opposite ends and lateral edges extending between said ends and consisting essentially of a synthetic resin that maintains flexibility at temperatures at least as low as 0° C.;
   (iii) first sheet attachment means providing an attachment to said frame for said elongated sheet at said blade end in position to receive snow thereon when said leading edge of said frame is propelled into an accumulation of snow; and
   (iv) second sheet attachment means providing an attachment for said second end of said flexible sheet member to said frame toward said handle end thereof to provide support of said second end of said sheet member by said frame, said sheet member and said first and second attachment means therefor being of sufficient length to permit slack in said sheet member, said sheet member being freely movable relative to said frame intermediate said attachment means and flexible enough to permit said sheet member with a load of snow thereon to assume a generally V-shaped form with one leg of the V resting on a generally horizontal surface when said blade end rests on the surface and said handle end is supported above the surface and to permit the vertex of the V to move forward along said sheet member as said handle end is raised so that the length of said leg resting on the generally horizontal surface is gradually reduced, whereby a load of snow resting on said sheet member is lifted only a portion at a time as said handle end is raised;

b. resting said blade end of said frame on a generally horizontal surface having snow thereon;

c. supporting said handle end of said frame above the horizontal surface;

d. propelling said blade end into an accumulation of snow on said surface to load snow onto said sheet member, said sheet member assuming a generally V-shaped form;

e. moving said snow-removal device to another location; and f. raising said handle end of said frame to move the vertex of the V forward along said sheet member and thereby remove the load of snow therefrom.

2. A snow-removal device comprising:

a. a frame having a blade end providing a leading edge adapted to be propelled into an accumulation of snow and having a handle end opposite said blade end for propelling said leading edge into the snow;

b. an elongated flexible sheet member having first and second opposite ends and lateral edges extending between said ends and consisting essentially of a synthetic resin that maintains flexibility at temperatures at least as low as 0° C.;

c. first sheet attachment means providing an attachment to said frame for said elongated sheet at said blade end in position to receive snow thereon when said leading edge of said frame is propelled into an accumulation of snow; and d. second sheet attachment means providing an attachment for said second end of said flexible sheet member to said frame toward said handle end thereof to provide support of said second end of said sheet member by said frame, said sheet member and said first and second attachment means therefor being of sufficient length to permit slack in said sheet member, said sheet member being freely movable relative to said frame intermediate said attachment means and flexible enough to permit said sheet member with a load of snow thereon to assume a generally V-shaped form with one leg of the V resting on a generally horizontal surface when said blade end rests on the surface and said handle end is supported above the surface and to permit the vertex of the V to move forward along said sheet member as said handle end is raised so that the length of said leg resting on the generally horizontal surface is gradually reduced, whereby a load of snow resting on said sheet member is lifted only a portion at a time as said handle end is raised.

3. The snow-removal device of claim 1 wherein said lateral edges of said sheet member are substantially free from attachment to said frame between said ends of said sheet member.

4. The snow-removal device of claim 1 or 3 wherein said first sheet-attachment means includes:

a. an elongated rigid member joined along the length thereof to said flexible sheet member along said first end of said sheet member to keep said first end rigid; and b. connection means connecting said rigid member to said frame at said blade end for pulling of said rigid member and thereby of said flexible sheet member by said frame, said connection means permitting some motion of said rigid member relative to said leading edge to allow one end of said rigid member to tilt to a position below the other when said leading edge is oriented horizontally.

5. The snow-removal device of claim 4 wherein said second attachment means includes a flexible cord depending from said frame at a point toward aid handle end thereof and connected to said flexible sheet to support it at its second end.

6. The snow-removal device of claim 5 wherein said second attachment means includes a second elongated rigid member joined along its length to said flexible sheet member along said second end thereof to keep said second end rigid and further includes a second flexible cord depending from said frame at one side thereof toward said handle end and attached to said rigid elongated member to support said second end of said sheet member, said first-mentioned flexible cord depending from said frame at the other side thereof and being attached to said elongated member to support said sheet member at said second end thereof.

7. The snow-removal device of claim 6 wherein said flexible sheet has an opening sized for extension therethrough of human fingers at the second end of said flexible sheet adjacent said rigid elongated member to facilitate grasping of said rigid member and thereby of said sheet.

8. The snow-removal device of claim 4 wherein said frame includes an elongated generally planar blade member disposed across said blade end thereof and providing said leading edge, the angle of the plane of said blade member being variable when said first end rests on the generally horizontal surface by the raising or lowering said handle end of said frame.

9. The snow-removal device of claim 8 wherein said connection means connecting said rigid member to said frame includes at least one S-hook connecting said blade member to said rigid member.

10. The snow-removal device of claim 1 or 3 wherein said frame includes an elongated generally planar blade member disposed across said blade end thereof and providing said leading edge, the angle of the plane of said blade member being variable by the raising or lowering said handle end of said frame when said first end rests on the generally horizontal surface.

11. The snow-removal device of claim 10 wherein said frame includes a generally U-shaped member having a pair of leg portions and a web portion extending between them at one end, the free ends of said leg portions being curved out of the plane of the U to provide a rocking surface at the other end at which said blade end of said frame can lie on the generally horizontal surface and along which it can be rocked as said handle end of said frame is raised and lowered, said blade member extending between and being fastened to the curved regions of said leg portions, the angle of the plane of said blade member thereby being variable by the raising and lowering of said handle end of said frame.

12. The snow-removal device of claim 11 wherein said frame further includes a second generally U-shaped member having two leg portions and a web portion extending between them, said web portion of said second U-shaped member providing a handle at said handle end of said frame, said leg portions of said second U-shaped member extending from said handle end generally parallel to said leg portions of said first U-shaped member, said frame further including frame attachment means attaching said leg portions of said second U-shaped member to said leg portions of said first U-shaped member adjacent said web portion thereof and supporting said second U-shaped member in its parallel position relative to said first U-shaped member but being loosenable to permit said second U-shaped member to pivot about said frame attachment means relative to said first U-shaped member for folding of said frame.

13. The snow-removal device of claim 1 or 3 wherein said sheet member consists essentially of polyethylene terephthalate.

14. The snow-removal device of claim 4 wherein said sheet member consists essentially of polyethylene terephthalate.

15. The snow-removal device of claim 10 wherein said sheet member consists essentially of polyethylene terephthalate.

16. The snow-removal device of claim 1 or 3 wherein said second attachment means includes a flexible cord depending from said frame at a point toward said handle end thereof and connected to said flexible sheet to support it at its second end.

17. The snow-removal device of claim 16 wherein said second attachment means includes an elongated rigid member joined along its length to said flexible sheet member along said second end thereof to keep said second end rigid and further includes a second flexible cord depending from said frame at one side thereof toward said handle and attached to said rigid elongated member to support said second end of said sheet member, said first-mentioned flexible cord depending from said frame at the other side thereof and being attached to said elongated rigid member to support said sheet member at said second end thereof.

18. The snow-removal device of claim 17 wherein said flexible sheet has an opening sized for extension therethrough of human fingers at the second end of said flexible sheet adjacent said rigid elongated member to facilitate grasping of said rigid member and thereby of said sheet.

19. The snow-removal device of claim 1 or 3 wherein said frame includes an elongated generally planar blade member disposed across said blade end thereof and providing said leading edge, the angle of the plane of said blade member being variable when said first end rests on the generally horizontal surface by the raising or lowering said handle end of said frame.

* * * * *